US006571666B1

(12) United States Patent
Te

(10) Patent No.: US 6,571,666 B1
(45) Date of Patent: Jun. 3, 2003

(54) HAMMER LOADABLE WITH DIFFERENT SIZES OF NAILS

(76) Inventor: Wu Shu Te, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 0 days.

(21) Appl. No.: 10/142,802

(22) Filed: May 13, 2002

(30) Foreign Application Priority Data

Nov. 15, 2001 (TW) ..... 90219687 U

(51) Int. Cl.[7] ..... B25D 1/00
(52) U.S. Cl. ..... 81/24; 81/23
(58) Field of Search ..... 81/23, 44, 24, 81/25

(56) References Cited

U.S. PATENT DOCUMENTS 569,161 A * 10/1896 Balsley ..... 81/23
589,178 A * 8/1897 Kelly ..... 81/23
1,960,390 A * 5/1934 Nadelman ..... 81/23
2,652,082 A * 9/1953 Zanelli ..... 81/23
2,871,480 A * 2/1959 Pezza et al. ..... 81/44
3,763,906 A * 10/1973 Crowder ..... 81/24
4,273,172 A * 6/1981 Hoosier ..... 81/23
4,465,115 A * 8/1984 Palomera ..... 81/24
6,332,376 B1 * 12/2001 Hurley ..... 81/23
6,339,974 B1 * 1/2002 Kotschner et al. ..... 81/24

* cited by examiner

*Primary Examiner*—D. S. Meislin
(74) *Attorney, Agent, or Firm*—Troxell Law Office PLLC

(57) ABSTRACT

Hammer loadable with different sizes of nails, including an adjustment member manually rotatably disposed on the hammerhead. A predetermined number of loading positions are formed on the adjustment member at intervals for loading a nail therein. The loading positions are spaced from the hammering end of the hammerhead by different distances. According to the length of the nail, the adjustment member can be turned to select one of the loading positions for loading the nail therein. The front end of the nail protrudes from the hammering end by a certain length, whereby the tip of the nail can be hammered into the surface of a work piece.

30 Claims, 8 Drawing Sheets

HAMMER LOADABLE WITH DIFFERENT SIZES OF NAILS

BACKGROUND OF THE INVENTION

The present invention is related to a hammer, and more particularly to a hammer loadable with different sizes of nails. The hammer is used to preliminarily hammer the tip of the nail into the surface of a work piece.

When nailing a work piece, a user must first hold a nail with one hand and use a hammer with the other hand to lightly hammer the nail and preliminarily strike the tip of the nail into the work piece by a certain depth. Thereafter, the nail is entirely hammered into the work piece. It often takes place that a user incautiously operates the hammer to strike his/her own hand holding the nail.

FIG. 1 shows a conventional hammer 10 having a hammerhead 12. The top face of the hammerhead 12 is formed with a longitudinal channel 14 having a depression 16 at rear end. A magnet (not shown) is embedded in the bottom wall of the channel 14. In use, the nail 18 is loaded in the channel 14 and attracted by the magnet. The head 19 of the nail is positioned and located in the depression 16. The front end of the nail protrudes from the hammerhead 12. A user can swing the hammer to a work piece to strike the tip of the nail into the work piece. Then, the hammer is separated from the nail to further entirely hammer the nail into the work piece. Accordingly, when preliminarily striking the tip of the nail into the surface of the work piece, it is unnecessary for the user to hold the nail with one hand. Therefore, the user's hand is prevented from being hammered and injured.

However, the sizes of the nails applicable to the above hammer are limited. Not all kinds of nails with different lengths are applicable to the hammer. This is because that the front end of the nail 18 protrudes from the hammerhead 12 by a certain length S and the channel 14 and the depression 16 of the hammerhead have fixed dimensions. Therefore, only those nails with sizes within a certain range are applicable to the hammer. In the case that the size of the nail is too small, the front end of the nail may fail to protrude from the hammerhead 12 or the protruding length S of the nail may be insufficient. Under such circumstance, the nail cannot be applied to the hammer. Reversely, in the case that the size of the nail is too long, the nail may have a diameter larger than the width of the channel 14 and cannot be placed into the channel 14. Under such circumstance, the nail also cannot be applied to the hammer. Even if the too long nail can be placed into the channel 14, the protruding length S of the nail will be too long, while the length D of the rear section of the nail attracted on the hammerhead will be insufficient. Accordingly, the gravity center of the nail will fall onto outer side of the hammerhead 12. As a result, during operation, the nail tends to bound away from the hammerhead and it is hard to strike the tip of the nail into the work piece.

Therefore, in order to use different sizes of nails, many kinds of hammers with different dimensions should be prepared. The large hammer is formed with large-size channel 14 and depression 16, while the small hammer is formed with small-size channel and depression in cooperation with the different nails. As a result, the purchase cost is increased and it is inconvenient to carry all these hammers.

SUMMARY OF THE INVENTION

It is therefore a primary object of the present invention to provide a hammer which is loadable with different sizes of nails. The hammer is used to preliminarily hammer the tip of the nail into the surface of a work piece.

The present invention can be best understood through the following description and accompanying drawings wherein:

DETAILED DESCRIPTION OF THE PREFERRED EMBODIMENTS

Figure 1:
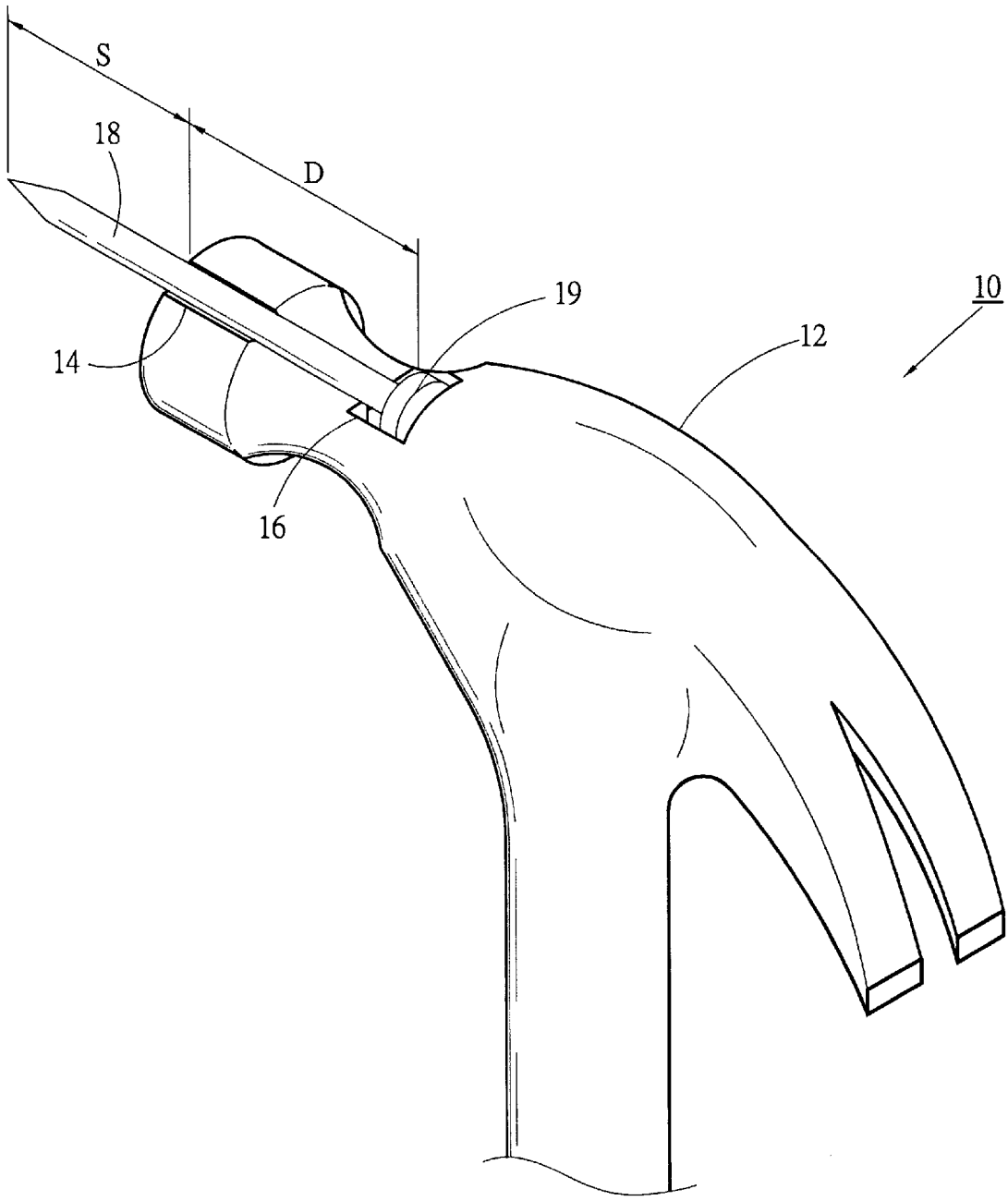
Fig. 1 PRIOR ART
FIG. 1 is a perspective view of a conventional hammer.
Figure 2:
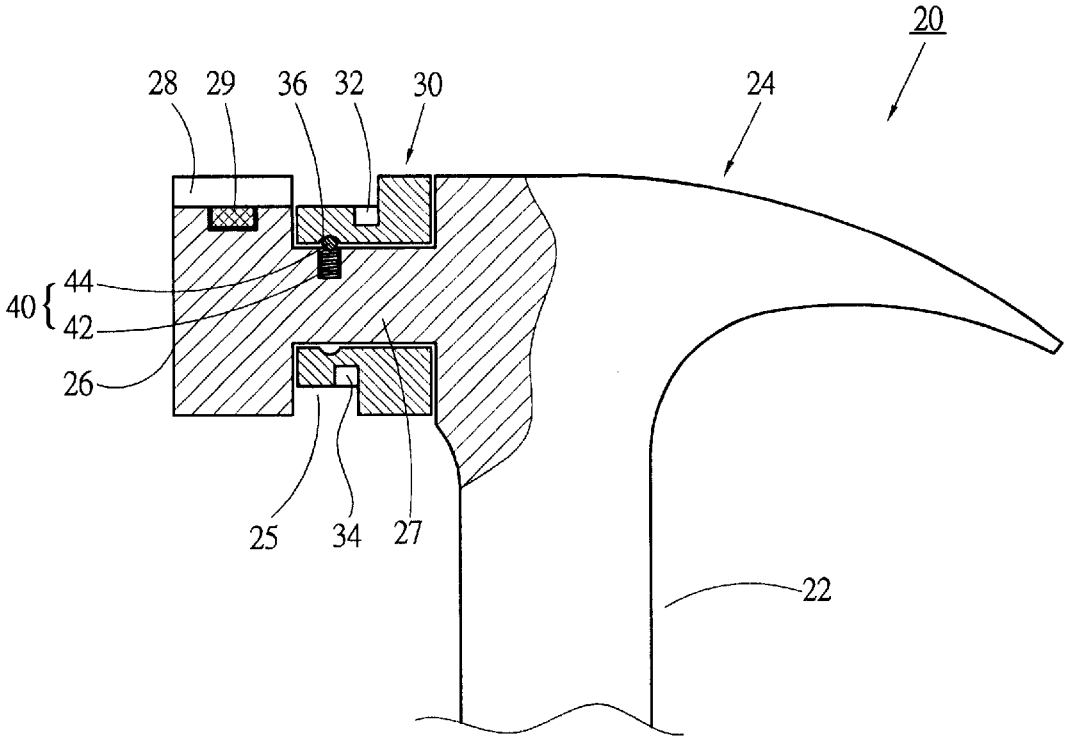
FIG. 2 is a sectional view of a preferred embodiment of the present invention.

Please refer to FIG. 2. According to a preferred embodiment of the present invention, the hammer 20 includes a hammer handle 22 and a hammerhead 24 disposed at one end of the hammer handle 22.

An adjustment member 30 is rotatably disposed on the hammerhead 24. The adjustment member 30 and the hammerhead 24 together form a head apparatus. In more detail, the inner side of the hammering end 26 of the hammerhead 24 is recessed to form an annular space 25. The center of the annular space 25 has a shaft 27. In this embodiment, the adjustment member 30 is a hollow cylindrical body rotatably fitted around the shaft 27 in the annular space 25. The axial direction of the adjustment member and the shaft is perpendicular to the longitudinal direction of the handle 22.

A channel 28 is formed on top face of the hammering end 26 along the longitudinal direction of the hammerhead 24. The rear end of the channel communicates with the annular space 25. An attractive member 29 such as a magnet is embedded in the bottom wall of the channel.

Figure 3:
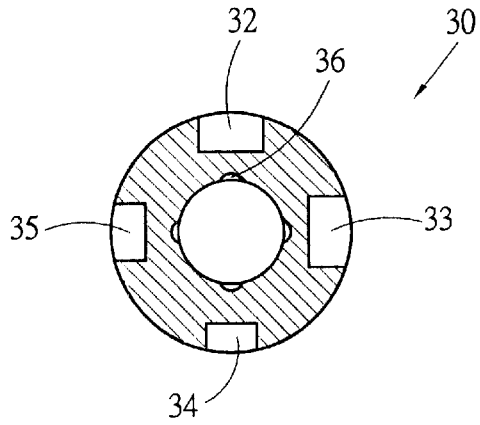
FIG. 3 is a cross-sectional view of the adjustment member of FIG. 2.
Figure 4:
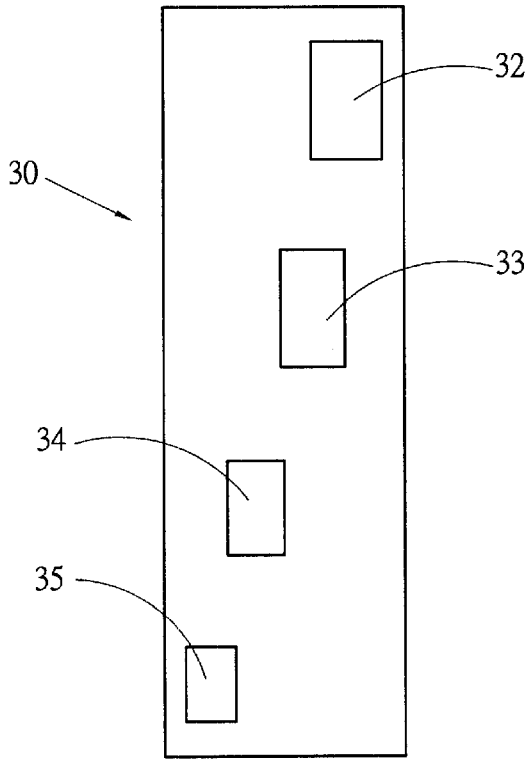
FIG. 4 is a stretched view of the adjustment member of FIG. 2.

The outer circumference of the adjustment member 30 is formed with four dents 32, 33, 34, 35 at intervals as shown in FIG. 3. The dents have different widths. Moreover, the dents 32 to 35 are spaced from the front end of the adjustment member 30 by different lengths as shown in FIG. 4. Four locating sections 36 are formed on inner circumference of the adjustment member at intervals equal to that of the dents.

A resilient retaining member 40 including a spring 42 and a ball body 44 is embedded in the shaft 27. The ball body 44 is pushed by the spring 42 to resiliently abut against one of the locating sections 36 so as to locate the adjustment member 30.

Figure 5:
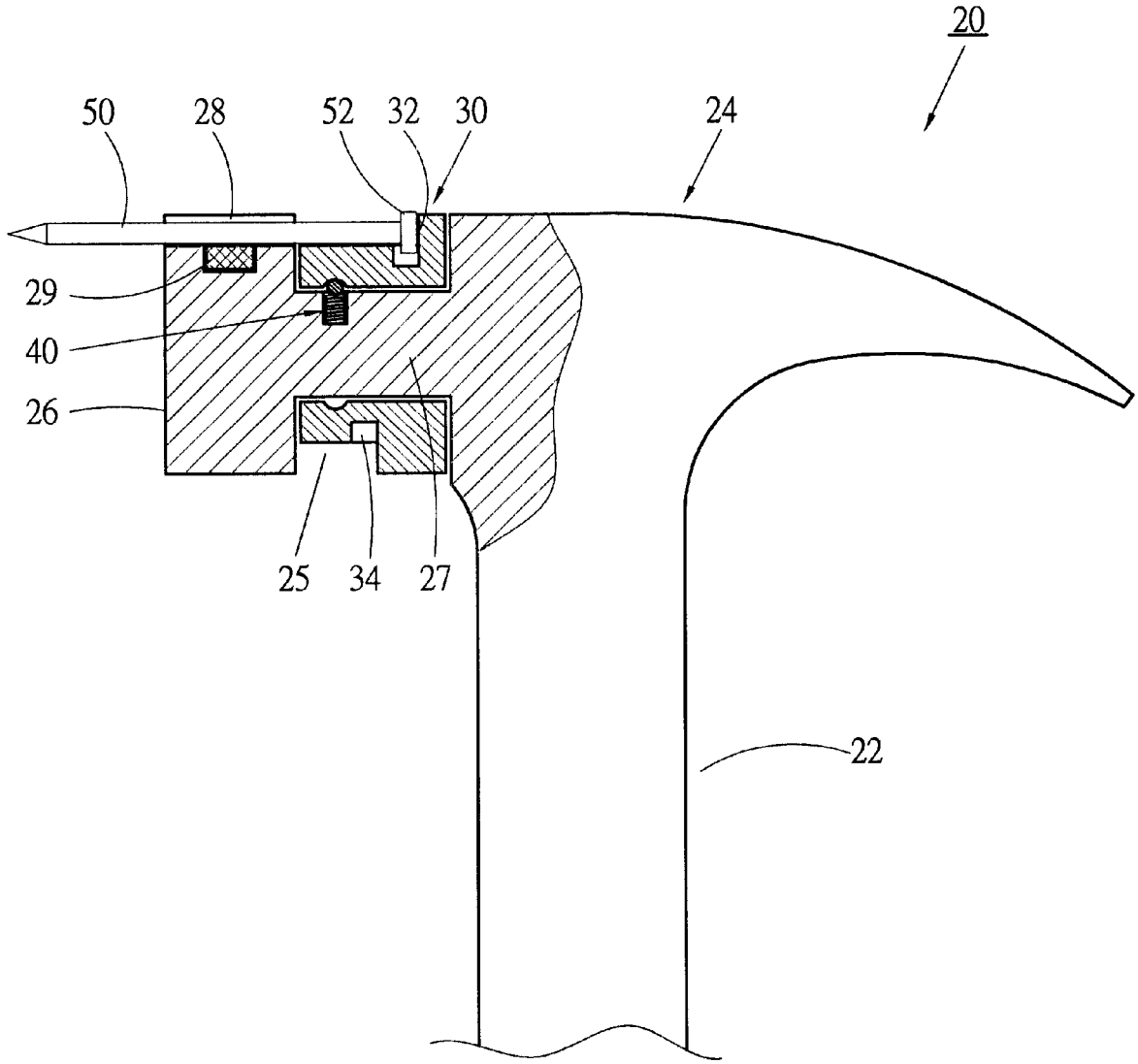
FIG. 5 is a view according to FIG. 2, showing that a longer nail is loaded on the hammer.

When the adjustment member 30 is turned to a position as shown in FIG. 5, where the dent 32 is positioned on top face behind the channel 28 and aligned with the channel 28. Under such circumstance, the dent 32 and the channel 28 provide a loading position and the adjustment member 30 is retained and located by the resilient member 40. At this time, a longer nail 50 can be placed into the channel 28 and attracted by the magnet 29. The head section 52 of the nail is placed into the dent 32 to abut against the wall face thereof. The front end of the nail protrudes from the hammerhead 24 by a certain length.

A user can swing the hammer to hammer the tip of the nail 50 into the surface of a work piece so as to preliminarily fix the nail on the work piece. Then the nail 50 is separated from the channel 28 and the dent 32 and the user can use the hammer to entirely hammer the nail into the work piece.

Figure 6:
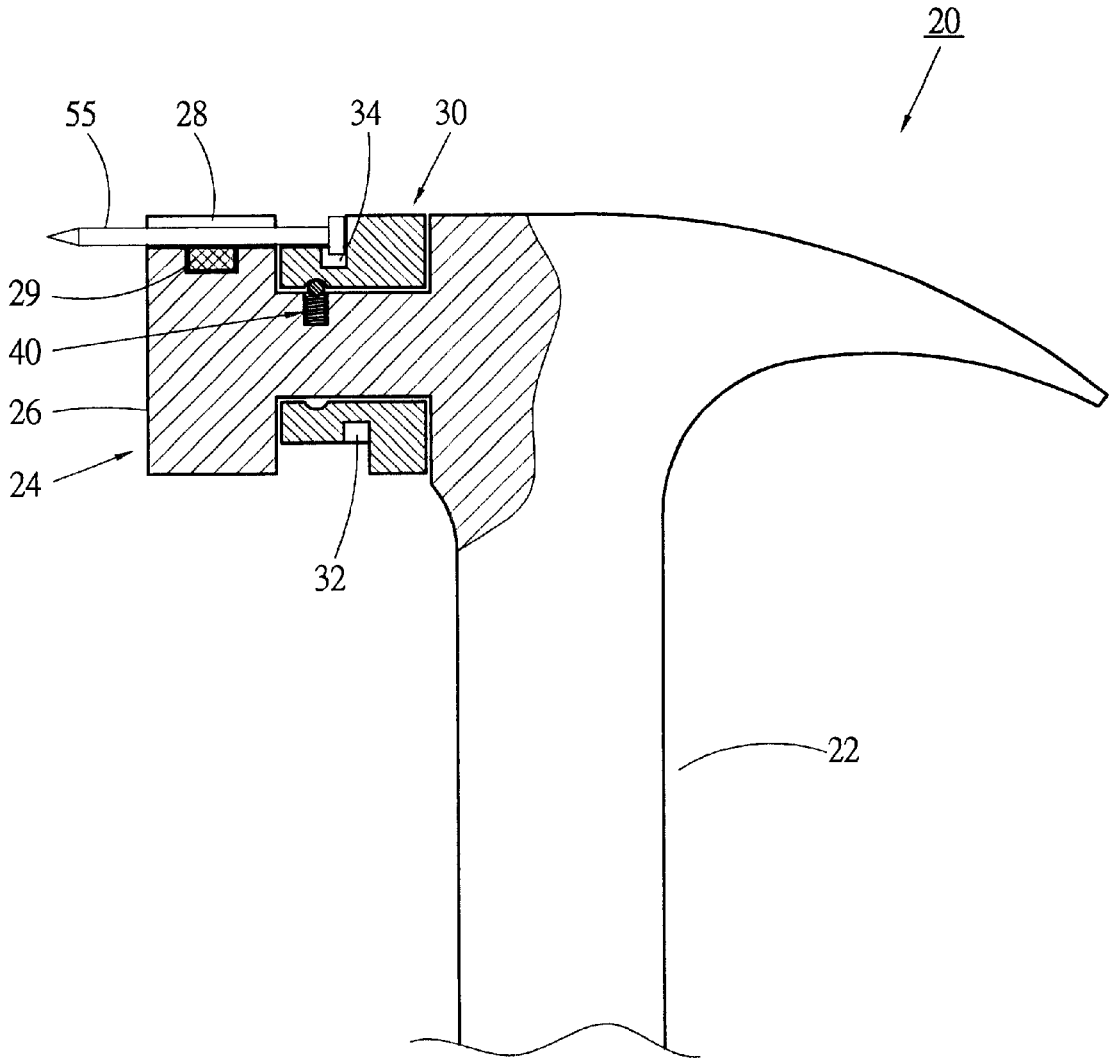
FIG. 6 is a view according to FIG. 5, showing that a shorter nail is loaded on the hammer.

When using a shorter nail 55, as shown in FIG. 6, the adjustment member 30 is turned to rotate the dent 34 to the top face. At this time, the dent 34 is aligned with the channel 28. Then the nail can be placed into the channel 28 and the dent 34. The front end of the nail also protrudes from the hammerhead 24 by a certain length to be hammered into the surface of a work piece. Accordingly, the different dents are spaced from the hammering end 26 by different lengths so that different sizes of nails are loadable.

Figure 7:
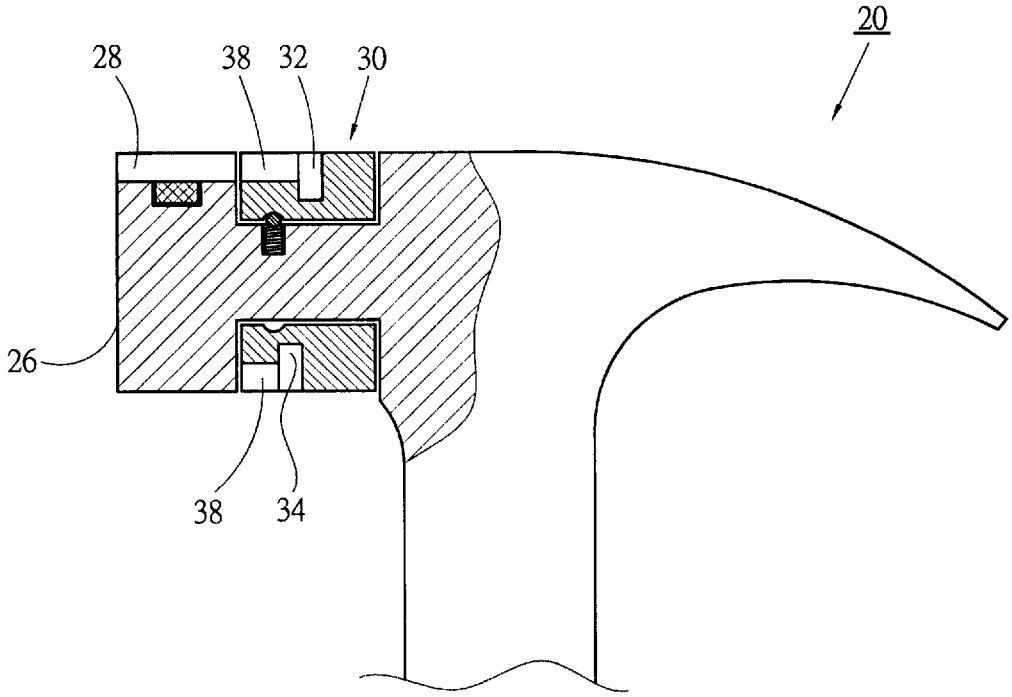
FIG. 7 is a sectional view of another embodiment of the present invention.

FIG. 7 shows another embodiment of the present invention, which is substantially identical to the embodiment of FIG. 2. The same element is denoted by the same reference numeral. In this embodiment, the front section of the adjustment member 30 in front of the dents 32 to 35 has a diameter larger than or equal to the diameter of the hammering end 26. The front section is formed with a longitudinal groove 38 to communicate with said channel 28 for receiving the nail therein.

Figure 8:
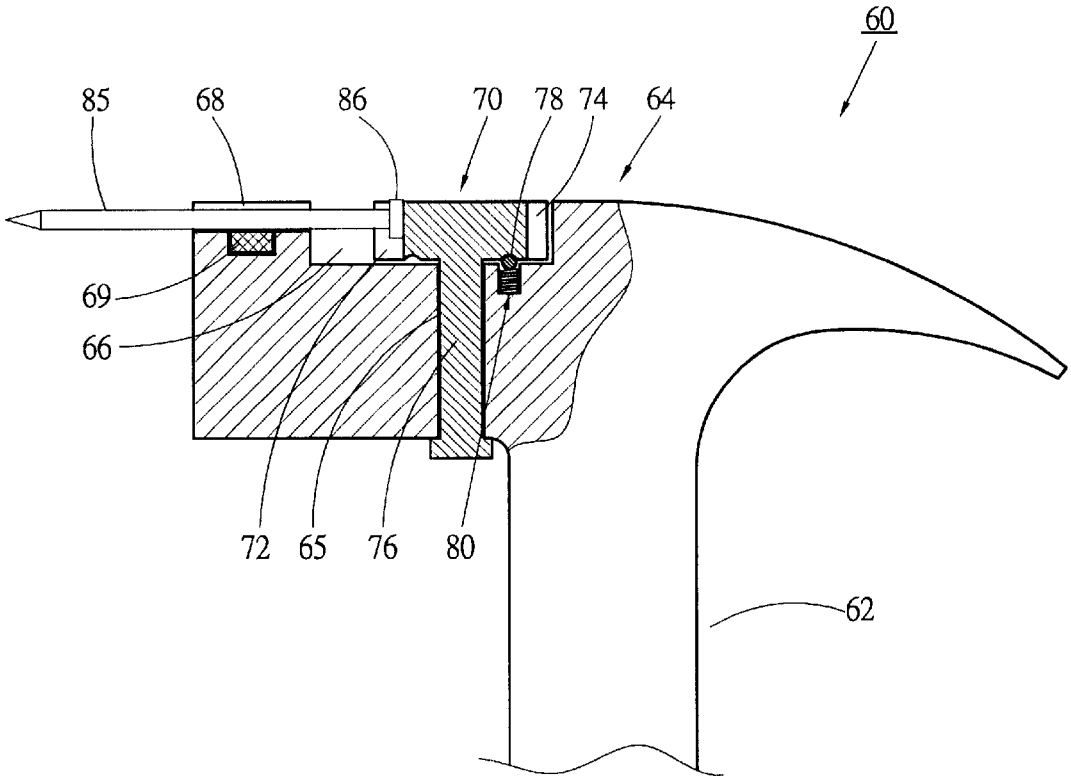
FIG. 8 is a sectional view of still another embodiment of the present invention.
Figure 9:
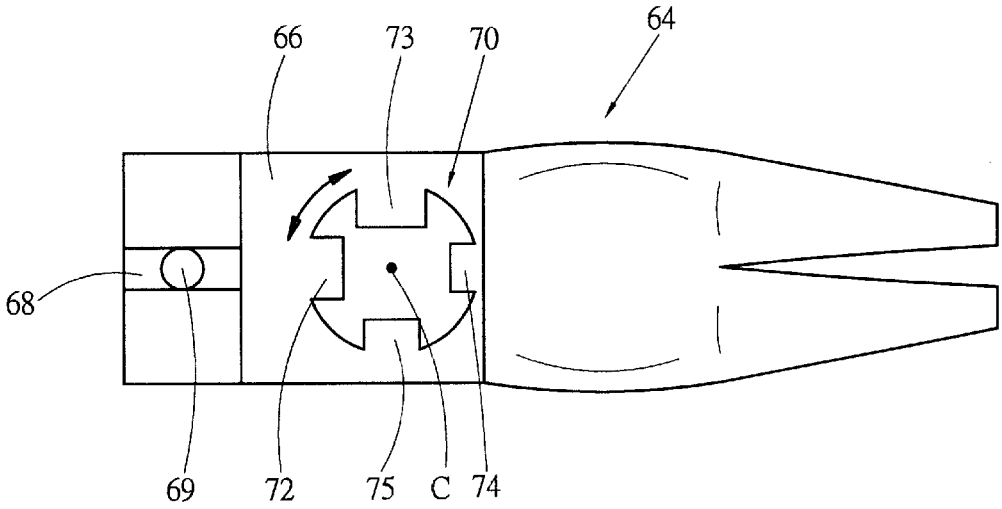
FIG. 9 is a top view according to FIG. 8.

FIGS. 8 and 9 show still another embodiment of the present invention, in which the hammer 60 includes a hammer handle 62, a hammerhead 64 and an adjustment member 70 rotatably disposed on the hammerhead 64. The rotational axis of the adjustment member is parallel to the handle 62.

In more detail, the adjustment member 70 is disc-shaped. The circumference of the adjustment member 70 is formed with four recesses 72 to 75 at intervals. A shaft 76 is disposed under bottom face of the adjustment member 70. The shaft 76 is fitted through a through hole 65 of the hammerhead 64. The adjustment member 70 is rotatable about the shaft 76. The adjustment member 70 is positioned in a cavity 66 formed on top face of the hammerhead 64. The bottom end of the shaft 76 is retained by a C-shaped retainer ring or enlarged as a rivet with larger outer diameter, whereby the shaft will not detach out of the through hole 65. The recesses 72 to 75 are spaced from the rotational center c of the adjustment member by different distances. Four locating sections 78 are formed on bottom face of the adjustment member at intervals.

A resilient retaining member 80 including a spring and a ball body is embedded in the hammerhead 64. The ball body is pushed by the spring to resiliently abut against one of the locating sections 78 of the adjustment member 70 so as to locate the same.

In use, a nail 85 is loaded into the channel 68 of the hammerhead 64 and attracted by the magnet 69. The head section 86 of the nail is placed in a recess 72. The front end of the nail also protrudes from the hammerhead by a certain length.

It can be easily known from FIG. 9 that by means of turning the adjustment member to align different recess 72, 73, 74 or 75 with the channel 68, the recess and the front end of the hammerhead define a different length. Accordingly, different recesses can be selected to load different lengths of nails therein to always make the front end of the loaded nail protrude from the hammerhead by a certain length.

Figure 10:
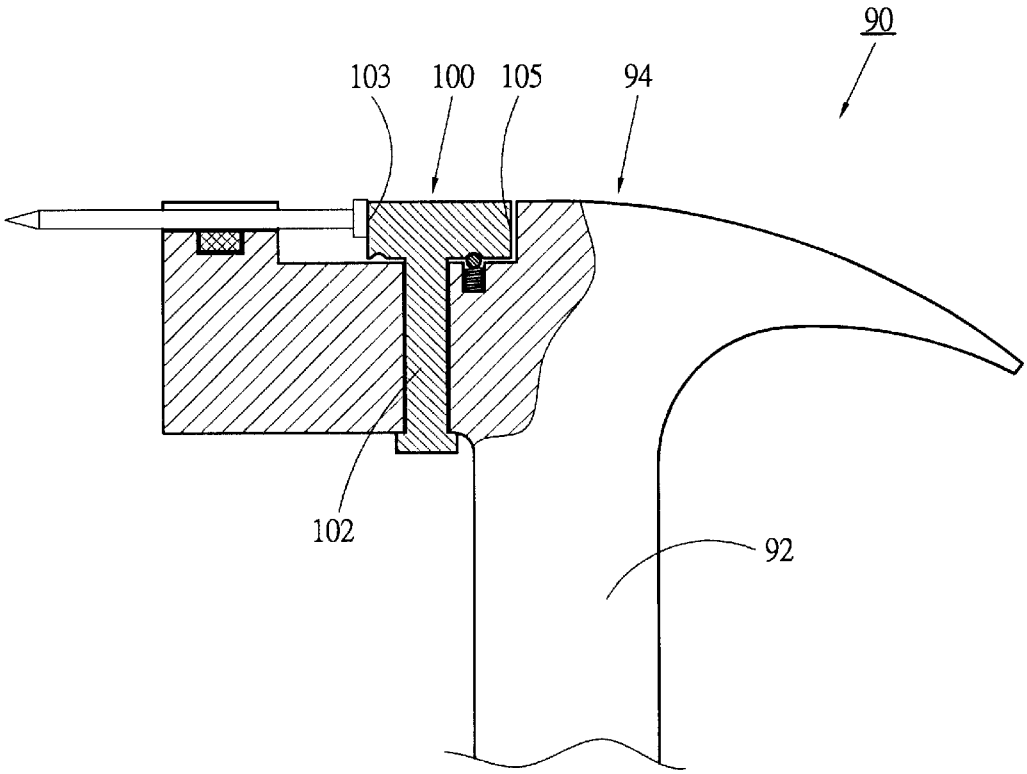
FIG. 10 is a sectional view of still another embodiment of the present invention.
Figure 11:
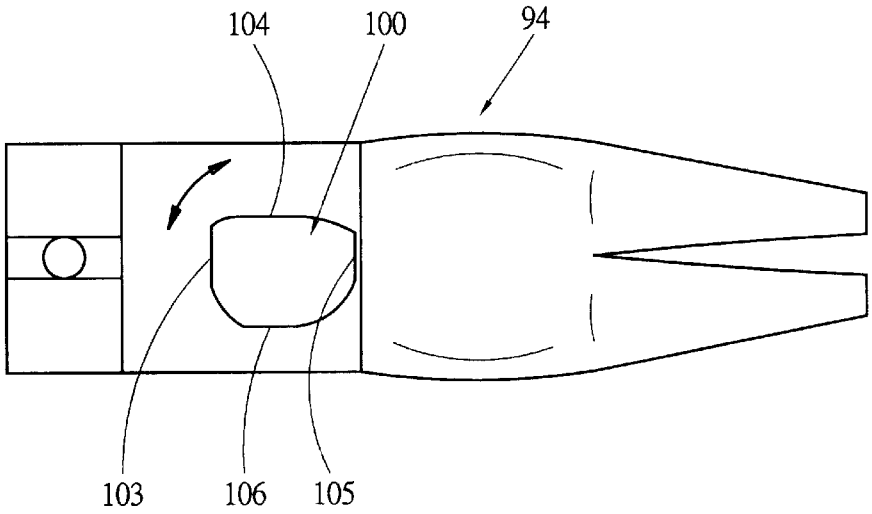
FIG. 11 is a top view according to FIG. 10.

FIGS. 10 and 11 show still another embodiment of the present invention, which is substantially identical to the embodiment of FIG. 8. The hammer 90 includes a hammer handle 92, a hammerhead 94 and an adjustment member 100 rotatably disposed on the hammerhead 94. The adjustment member has a shaft 102 fitted through the hammerhead.

The circumference of the adjustment member 100 is formed with four plane abutting sections 103 to 106 which are spaced from the rotational center of the adjustment member by different distances. Accordingly, different nails with different lengths are loadable.

Figure 12:
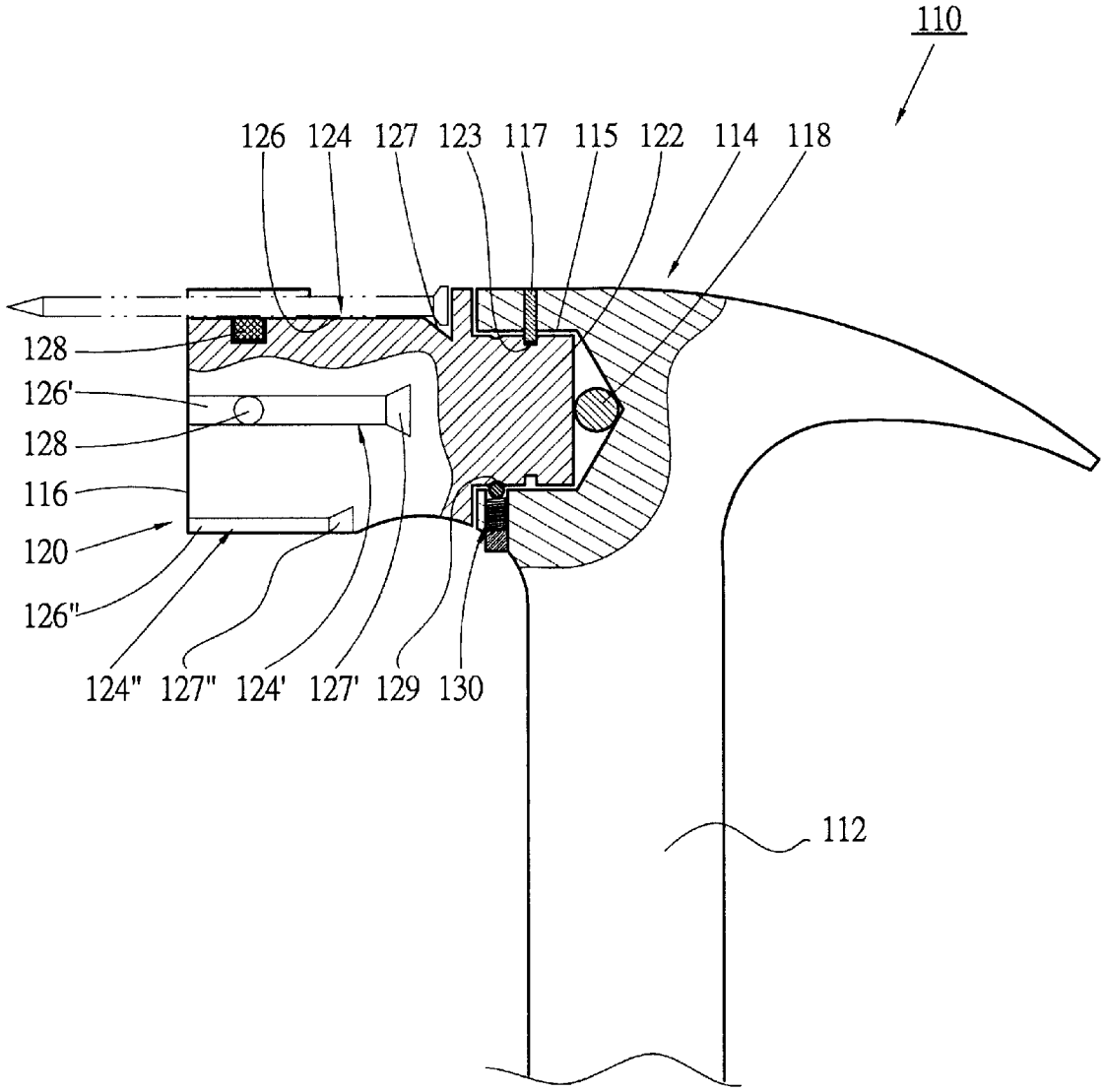
FIG. 12 is a partially sectional view of still another embodiment of the present invention.

FIG. 12 shows still another embodiment of the present invention, in which the front end of the hammerhead 114 of the hammer 110 is inward recessed to form a shaft hole 115. The adjustment member 120 is cylindrical and has a shaft 122 at rear end. The shaft is fitted in the shaft hole 115, whereby the adjustment member is rotatable on the hammerhead. The rotational axis of the adjustment member is perpendicular to the hammer handle 112. The adjustment member 120 and the hammerhead 114 form a head apparatus. The front end of the adjustment member 120 is formed as the hammering end 116 of the head apparatus. An insertion pin 117 is disposed in the hammerhead 114 and inserted into an annular groove 123 formed on the shaft so as to prevent the shaft from detaching out of the shaft hole. A steel ball 118 is disposed between the wall of the shaft hole and the shaft for reducing frictional force against the adjustment member when turned.

The adjustment member 120 has a certain length. The circumference of the adjustment-member 120 is formed with multiple (for example, four) loading sections 124, 124', 124". Each loading section 124 has a longitudinal channel 126 and a dent 127 communicating with rear end of the channel. The channels 126, 126', 126" have different lengths, whereby the dents 127, 127', 127" are spaced from the hammering end 116 by different distances. A magnet 128 is disposed in the bottom wall of each channel 126. In practice, the shorter channel 126 has a smaller width.

A resilient retaining member 130 is disposed in inner side of the wall of the shaft hole 115 for abutting against one of several locating sections 129 formed on the circumference of the shaft 122, whereby the adjustment member can be turned to a certain position and located therein.

In use, to both left-handed and right-handed users, the top face of the adjustment member is an optimal visual position. In the case that a longer nail is to be used, a longer channel 126 is turned to the top face for loading the nail therein. Reversely, in the case that a shorter nail is to be used, a shorter channel 126", is turned to the top face.

The present invention is characterized in that the adjustment member is rotatably mounted on the hammerhead of the hammer. The adjustment member is formed with multiple dents or abutting sections or loading sections spaced from the hammering end of the hammer by different lengths. Accordingly, different nails with different sizes can be loaded in the loading section with the front end of the nail protruding outward from the hammerhead by a certain length. Therefore, the tip of the nail can be hammered into the surface of a work piece. Different sizes of nails are applicable to the present invention so that the purchase cost is saved. The loaded nail is always positioned in the same position on top face of the hammerhead so that the nail can be optimally seen and precisely hammered into the work piece.

The above embodiments are only used to illustrate the present invention, not intended to limit the scope thereof.

What is claimed is:

1. Hammer loadable with different sizes of nails, comprising:

a hammer handle;

a hammerhead disposed at one end of the hammer handle;

an adjustment member rotatably disposed on the hammerhead, the adjustment member and the hammerhead forming a head apparatus;

a hammering end formed at one end of the head apparatus; and a predetermined number of loading positions being disposed on the head apparatus at intervals for loading a nail in one of the loading sections, the loading sections being spaced from the hammering end by different lengths, whereby when loading a nail, according to the length of the nail, the adjustment member is turned to select one of the loading sections for loading the nail therein with the front end of the nail protruding from the hammering end by a certain length.

2. Hammer loadable with different sizes of nails, comprising:

a hammer handle;

a hammerhead disposed at one end of the hammer handle;

an adjustment member rotatably disposed on the hammerhead, the adjustment member and the hammerhead forming a head apparatus having a hammering end formed at one end thereof;

at least one channel being formed on the circumference of the hammering end, the longitudinal direction of the channel being parallel to the longitudinal direction of the head apparatus; and a predetermined number of abutting sections being disposed on the adjustment member at intervals, the abutting sections being spaced from the hammering end by different lengths, whereby according to the length of the nail, the adjustment member is turned to select and align one of the abutting sections with the channel for loading the nail therein with the head section of the nail positioned at the abutting section and with the front end of the nail protruding from the hammering end by a proper length.

3. Hammer loadable with different sizes of nails, comprising:

a hammer handle;

a hammerhead disposed at one end of the hammer handle, a front end of the hammerhead being a hammering end, a channel being formed on the circumference of the hammering end, the longitudinal direction of the channel being parallel to the longitudinal direction of the hammerhead;

an adjustment member rotatably disposed on the hammerhead behind the channel; and a predetermined number of abutting sections being disposed on the adjustment member at intervals, by means of turning the adjustment member, one of the different abutting sections being positioned right behind the channel, and the abutting sections being spaced from the hammering end by different lengths, whereby according to the length of the nail, the adjustment member is turned to select and align one of the abutting sections with the channel for loading the nail therein with the head section of the nail positioned in the abutting section and with the front end of the nail protruding from the hammering end by a certain length.

4. Hammer as claimed in claim 3, wherein the rotational axis of the adjustment member is substantially parallel to the longitudinal direction of the hammerhead.

5. Hammer as claimed in claim 4, wherein the adjustment member is a hollow cylindrical body rotatably fitted on the hammerhead, the abutting sections being dents formed along the circumference of the adjustment member at intervals.

6. Hammer as claimed in claim 5, wherein an inner side of the hammering end of the hammerhead is recessed to form an annular space, a shaft being formed at a center of the annular space, the shaft being parallel to the longitudinal direction of the hammerhead, the adjustment member being rotatably fitted around the shaft in the annular space.

7. Hammer as claimed in claim 5, wherein a groove is formed in front of each dent, the front end of the groove extending through the front end of the adjustment member, the rear end of the groove communicating with the dent.

8. Hammer as claimed in claim 3, wherein the rotational axis of the adjustment member is substantially perpendicular to the longitudinal direction of the hammerhead.

9. Hammer as claimed in claim 8, wherein the adjustment member is disc-shaped, the abutting sections being disposed on the circumference of the adjustment member at intervals, a shaft being disposed between the adjustment member and the hammerhead, whereby the adjustment member is rotatable about the shaft, the abutting sections being spaced from the shaft by different distances.

10. Hammer as claimed in claim 9, wherein the abutting sections are recesses.

11. Hammer as claimed in claim 9, wherein the abutting sections are plane abutting sections formed on the circumference of the adjustment member.

12. Hammer as claimed in claim 8, wherein the circumference of the hammerhead is formed with a cavity in which the adjustment member is pivotally disposed.

13. Hammer as claimed in claim 9, wherein the top face of the hammerhead is formed with a cavity, the shaft being disposed under bottom face of the adjustment member, the adjustment member being positioned in the cavity and via the bottom end of the shaft pivotally connected with the hammerhead.

14. Hammer loadable with different sizes of nails, comprising:

a hammer handle;

a hammerhead disposed at one end of the hammer handle;

an adjustment member, a rear end of the adjustment member being pivotally connected with the front end of the hammerhead, hereby the adjustment member is rotatable on the hammerhead, a hammering end being formed at front end of the adjustment member; and a predetermined number of loading sections being formed on the circumference of the adjustment member at intervals, each loading section having a channel and a dent at the rear end of the channel, the channels being parallel to the axial direction of the adjustment member and having different lengths so that the dents are spaced from the hammering end by different distances, whereby according to the length of the nail, the adjustment member is turned to select one of the loading sections for loading the nail into the channel of the selected loading section with the head section of the nail positioned in the dent and with the front end of the nail protruding from the hammering end by a certain length, by means of turning the adjustment member, the selected loading section being turned to an optimal visual position.

15. Hammer as claimed in claim 14, wherein a shaft disposed between the rear end of the adjustment member and the front end of the hammerhead, the adjustment member being rotatable about the shaft.

16. Hammer as claimed in claim 15, wherein the shaft is disposed at rear end of the adjustment member, the front end of the hammerhead being recessed to form a shaft hole, the shaft being pivotally fitted in the shaft hole.

17. Hammer as claimed in claim 16, wherein the circumference of the shaft is formed with an annular groove, an insertion pin being disposed in the hammerhead and inserted in the annular groove.

18. Hammer as claimed in claim 16, wherein a predetermined number of rolling members are disposed between the wall of the shaft hole and the shaft.

19. Hammer as claimed in claim 1, further comprising a resilient retaining member disposed between the hammerhead and the adjustment member for locating the adjustment member.

20. Hammer as claimed in claim 2, further comprising a resilient retaining member disposed between the hammerhead and the adjustment member for locating the adjustment member.

21. Hammer as claimed in claim 3, further comprising a resilient retaining member disposed between the hammerhead and the adjustment member for locating the adjustment member.

22. Hammer as claimed in claim 14, further comprising a resilient retaining member disposed between the hammerhead and the adjustment member for locating the adjustment member.

23. Hammer as claimed in claim 1, wherein at least an attractive member is disposed in each loading position.

24. Hammer as claimed in claim 2, wherein at least an attractive member is disposed in bottom wall of each channel.

25. Hammer as claimed in claim 3, wherein at least an attractive member is disposed in bottom wall of each channel.

26. Hammer as claimed in claim 14, wherein at least an attractive member is disposed in bottom wall of each channel.

27. Hammer as claimed in claim 1, wherein each loading position is magnetic.

28. Hammer as claimed in claim 2, wherein each abutting section is magnetic.

29. Hammer as claimed in claim 3, wherein each abutting section is magnetic.

30. Hammer as claimed in claim 14, wherein each loading section is magnetic.

* * * * *